United States Patent [19]

Kiss

[11] 4,027,407

[45] June 7, 1977

[54] JET FLOW ALTERNATOR

[76] Inventor: Sandor G. Kiss, 236 E. Sunset Ave., Lombard, Ill. 60148

[22] Filed: Nov. 24, 1975

[21] Appl. No.: 634,550

[52] U.S. Cl. ..... 37/61; 37/63; 37/72; 60/221; 60/228; 98/40 B; 98/40 VM; 115/11; 115/12 R; 115/14; 137/829; 137/832; 138/39; 138/148; 175/67; 175/71; 175/324; 175/422; 180/7 J; 239/127.3; 239/265.19; 239/555; 302/14; 302/15; 417/151; 417/179; 417/183; 417/187; 417/197

[51] Int. Cl.[2] ..... E02F 3/92; F04F 5/00; F04F 5/42; B63H 11/00

[58] Field of Search ..... 37/54, 61, 56, 62, 63, 37/78, 67; 302/14, 15, 58; 417/183, 184, 90, 87, 108, 109, 151, 163, 169, 170, 172, 178, 179, 180, 187, 190, 197; 239/265.27, 407, 414, 265.17, 265.19, 265.23, 127.3, 562, 554, 555; 60/221, 222, 228–232, 264, 242, 227; 115/11, 12 R, 14, 15; 175/67, 69, 71, 205, 212, 324, 422; 137/829, 832; 98/40 UM, 40 B, 101; 180/7.5; 138/39, 148; 251/340

[56] References Cited

UNITED STATES PATENTS

| | | | |
|---|---|---|---|
| 885,930 | 4/1908 | Lake | 37/56 |
| 1,861,349 | 5/1932 | Lockett | 37/67 |
| 2,790,395 | 4/1957 | Garrett et al. | 417/109 |
| 3,002,344 | 10/1961 | Skopyk | 60/229 X |
| 3,087,302 | 4/1963 | Brown | 60/221 |
| 3,599,733 | 8/1971 | Varley | 175/67 |
| 3,656,495 | 4/1972 | Noren | 137/832 |
| 3,657,829 | 4/1972 | Lovelace | 37/63 |
| 3,672,293 | 6/1972 | Gona et al. | 98/40 UM |
| 3,909,960 | 10/1975 | Casciano | 37/72 X |
| 3,933,113 | 1/1976 | Dornak, Jr. | 115/12 R |

*Primary Examiner*—Clifford D. Crowder
*Assistant Examiner*—Steven A. Bratlie
*Attorney, Agent, or Firm*—Elmer L. Zwickel; Eugene F. Friedman

[57] ABSTRACT

A jet flow alternator for reversing the flow of a confined fluid stream which includes selectively controlled tubes to cause said stream to flow in either one of two directions under pressure.

8 Claims, 10 Drawing Figures

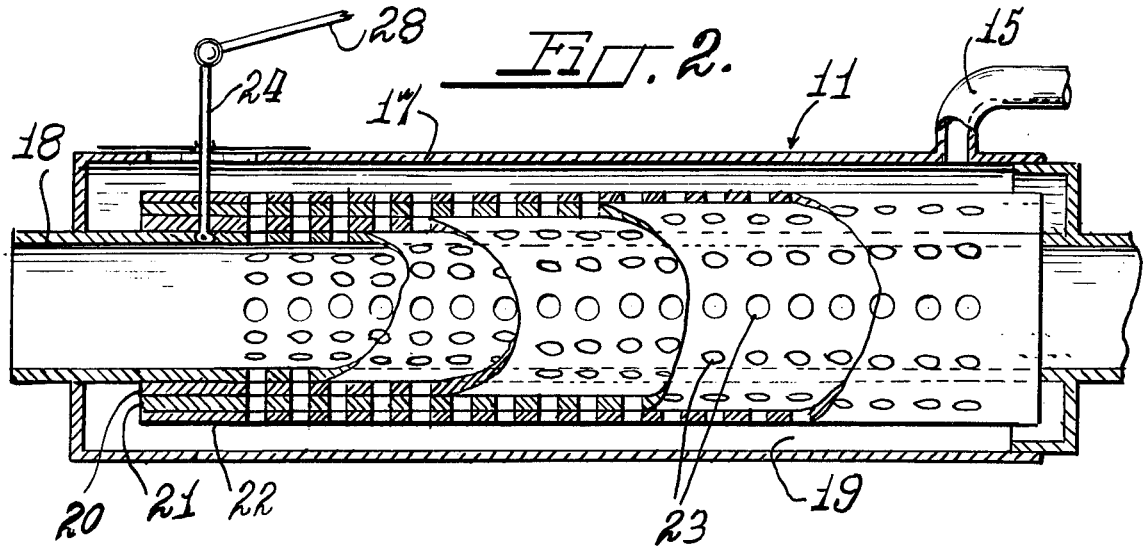
FIG. 2.
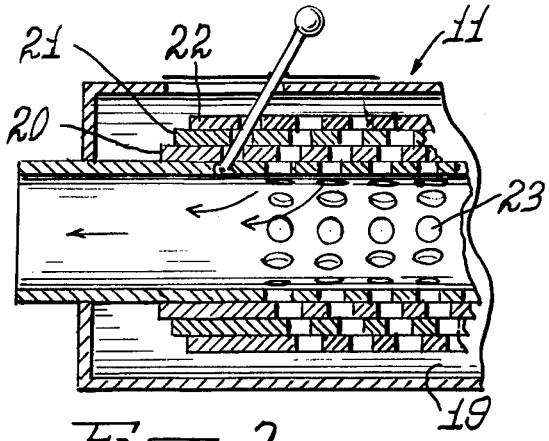
FIG. 3.
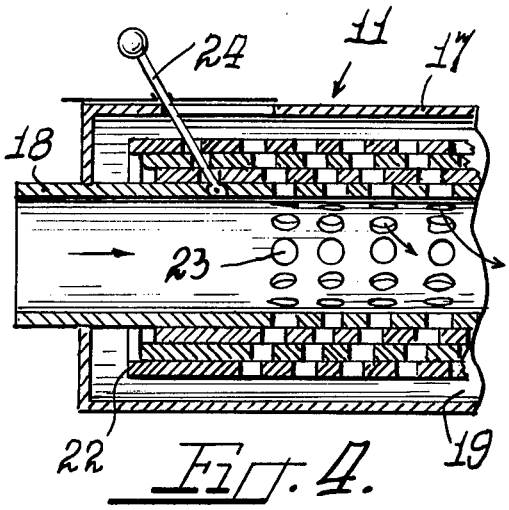
FIG. 4.
FIG. 9.
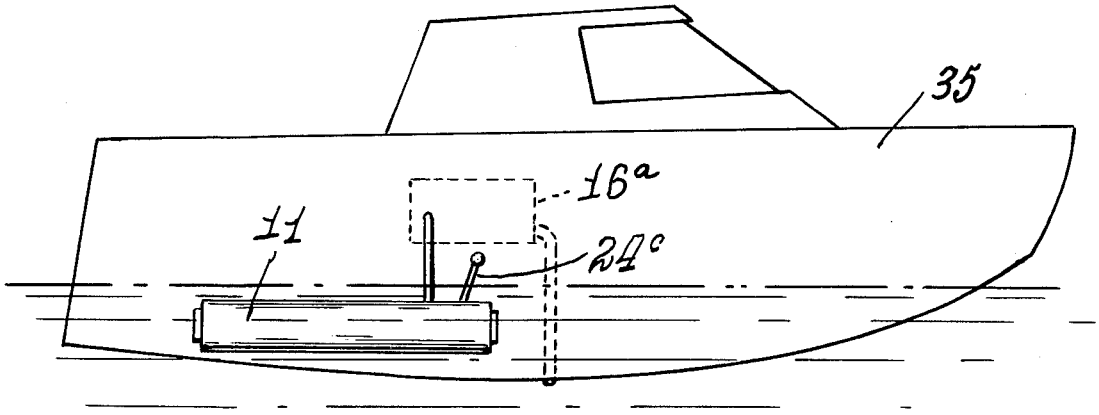

JET FLOW ALTERNATOR

The invention relates to improvements in jet flow alternators and is more particularly concerned with a novel assembly comprised essentially of a multitude of telescoped tubes each bearing circumferentially spaced rows of perforations, with a multitude of the perforations in each tube disposed in radial alignment or for angular alignment one with the other in either direction along their length so as to direct flow of pressurized fluid toward either end of the assembly for propelling sludge or a liquid through the innermost tube. This structure is useful to propel a vehicle forwardly or rearwardly, to assist in the drilling of solid substances and for conveying a fluid therethrough in either direction and for loosening and conveying sludge, etc., from the bottom of a body of water.

Associated with the assembly is a source of pressurized fluid and the assembly includes manual or motor controlled means to shift the tubes relative to one another so as to align the perforation therein one with the other either in radial alignment or angularly in opposite directions.

In one embodiment of the invention disclosed herein the jet flow alternator is incorporated at the receiving end of the suction line of a dredge and is operable to alternatively loosen sand, silt, weeds, etc., from the bottom of a body of water and to then suck such sludge, etc., from the bottom for disposal.

Other adaptations comprise embodying the jet flow alternator in the shaft of a boring drill so as to alternately direct pressurized fluid into the drill hole for loosening earth, etc., and then to reverse the flow direction upwardly to assist withdrawal of the sludge, etc.

The jet flow alternator can be incorporated into a land or water vehicle for providing jet propulsion in either a forward or rearward direction, and may be useful in a fluid pipe line to assist the flow of fluid therethrough.

It is therefore an object of the invention to provide a jet flow alternator of the character referred to.

Another object is to provide a novel telescoped tube assembly wherein the tubes may be shifted relative to one another to radially or angularly align circumferentially spaced perforations in the walls of each tube one with the other.

Another object is to provide a dredge apparatus with the novelly constructed jet flow alternator for generating a jet propelled stream of air or water onto the bottom of a body of water for loosening the mass thereof and for then discharging the resulting sludge by jet propulsion.

Another object is to provide a jet flow alternator for propelling a land or water vehicle forwardly or rearwardly.

Another object is to provide a jet flow alternator in a well boring tool including novel means to direct a pressure flow against the surface being worked or toward the discharge end of the tool.

Another object is to provide a jet flow alternator of a character that is not expensive to manufacture or use, and one that is very efficient in use.

Other objects and advantages of the invention will become apparent with reference to the following description and accompanying drawings.

IN THE DRAWINGS

FIG. 2 is an enlarged axial sectional view of the alternator connected to the suction line of FIG. 1, showing the tubes in neutral position.

FIG. 3 is a view of a fragmentary portion of the FIG. 2 disclosure, showing the tubes in position to discharge in one direction.

FIG. 4 is a view similar to FIG. 3, showing the tubes positioned to discharge in the opposite direction.

FIG. 9 is illustrative of the adaptation of the jet flow alternator to a water vehicle.

The jet flow alternator of the present invention is designed to generate a jet propelled stream of water, steam or air and direct it into a fluid stream from a neutral position into a forward or rearwardly direction so as to control the direction and pressure of flow of said fluid stream or the like in either direction and in various directions between the two extremes.

Figures 1, 8:
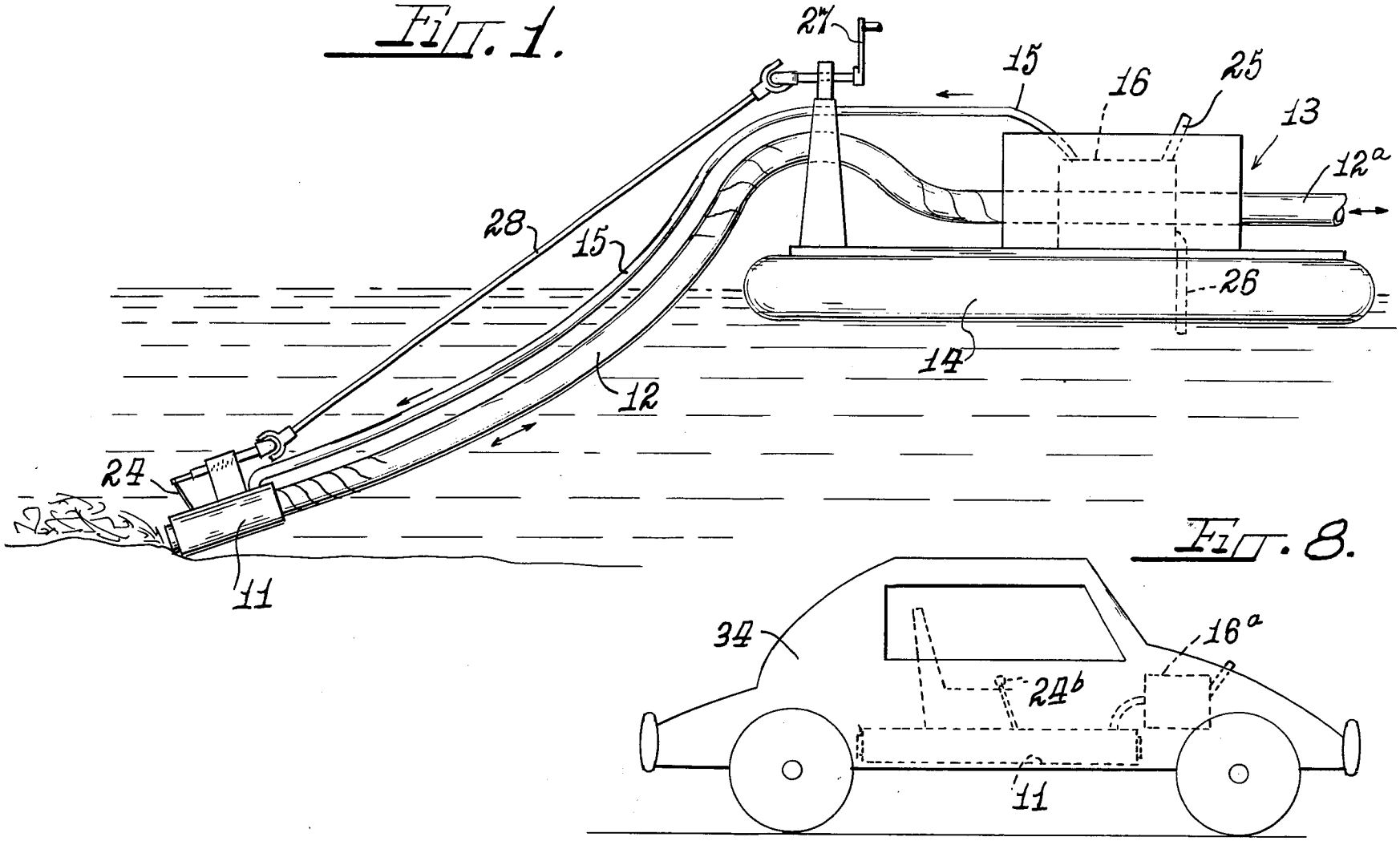
FIG. 1 is a side elevational view of a representative dredge showing the jet flow alternator of this disclosure attached to its suction line.
FIG. 8 is illustrative of the adaptation of the directional control or jet flow alternator to a land vehicle.

Referring to the representative illustration in FIG. 1, the jet flow alternator generally indicated at 11, which is of substantially the same basic construction in all adaptations herein disclosed, is shown mounted on the free end of the suction line 12 of a dredge 13. This suction line 12 has its free end submerged to the bottom of a body of water and it is carried upwardly over a barge 14 or the like for discharge through line extension **12*a*** onto land or other surface. In use, the alternator functions to loosen, remove and discharge sludge, weeds, sand, etc., from the bottom. Frequently, the bottom is hard and requires some aid to loosen the material to be removed hence the jet flow alternator is designed to not only generate a jet propulsion stream for discharge of sludge, etc., but to also generate a jet stream onto the bottom to loosen the ground to be dredged.

To these ends, the jet flow alternator 11 is designed to direct a jet stream of air, steam or water, entering same under pressure, through a feed line 15 connected to a pump 16, downwardly and out through the free end of the dredge line 12 for loosening sludge, etc., or upwardly to carry the recovered sludge out through the dredge line extension **12*a*** for discharge.

The jet flow alternator 11, best shown in FIGS. 2–4, is comprised of an outer shell 17 and an inner pipe 18 defining a tubular chamber 19 between them. The chamber houses a plurality of axially shiftable tubes 20, 21 and 22, telescoped snuggly one over the other and over the inner pipe 18. The fluid pressure line 15 opens into chamber 19 surrounding the tubes and when the tubes are in position to cause radial alignment of the series of circumferentially arranged ports 23 in each tube and the pipe 18, as shown in FIG. 2, the pressure entering through said aligned ports into the interior of pipe 18 is neutral. That is, the steam is disbursed uniformily in all directions within pipe 18. Common means, in the form of a lever 24 is connected to each of said tubes so that when the lever is rocked in one direction (to the right in FIG. 3) the tubes are shifted to the right so as to offset the ports 23 angularly and cause the pressure stream entering chamber 19 through line 15, to be directed to the free open or working end of suction line 12 so as to loosen the material on the bottom of the body of water. Obviously, the pressure stream in line 15 can comprise air admitted to the pump 16 through inlet 25 or water admitted through an inlet 26. In the FIG. 1 embodiment the lever 24 is operated through a crank 27 connected to it through a universal shaft 28.

When the lever 24 is shifted in the opposite direction (to the left as in FIG. 4) the pressure stream from chamber 19 is directed in the opposite direction so as to carry loosened sludge, weeds, etc., upwardly through suction line 12 for discharge. It will be apparent that the operator has complete control over the direction of flow and that the flow direction can be alternately reversed so as to loosen and then discharge sludge and other residue, as required by existing conditions on the bottom being dredged.

Figure 5:
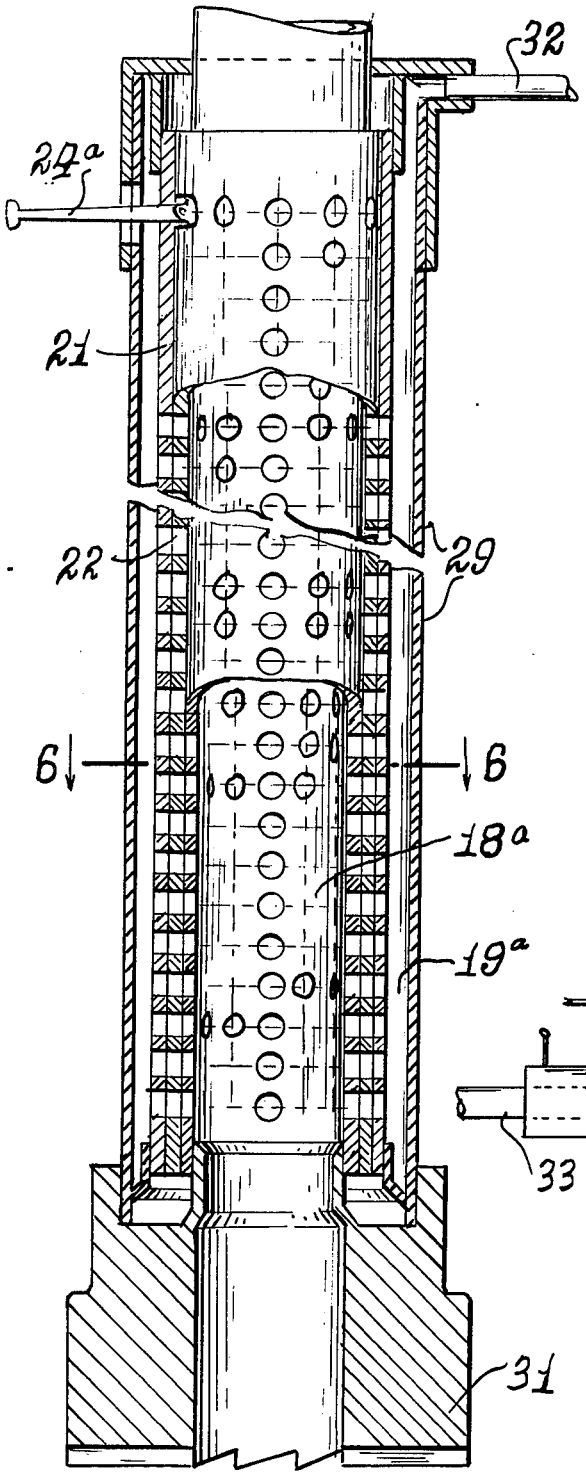
FIG. 5 is illustrative of the application of the jet flow alternator to a drilling tool.
Figure 6:
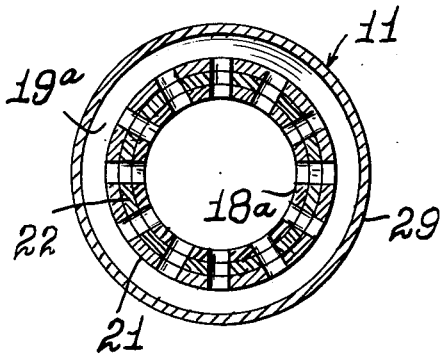
FIG. 6 is a diametrical sectional view of the drilling tool shaft shown in FIG. 5.

FIG. 5 is representative of the incorporation of the basic principals of the jet flow alternator in the shaft of a boring tool, and like numerals identify corresponding parts. As shown, the structure of the alternator is substantially like that shown in FIG. 2 except that here the outer shell 17 of the FIG. 2 alternator constitutes the hollow shaft 29 of the boring drill and it carries firmly on its lower end a drill bit 31. As before, the tubes 20, 21 (only two shown) are shiftable axially relative to each other and to the inner pipe 18*a*, so as to control directional flow for alternately loosening the surface of the drill hole and then expelling the residue upwardly through the axial pipe 18*a*. The means to shift the tubes may comprise a lever 24*a* arranged at the upper end of the boring drill, which end will also carry an inlet line 32 for pressurized air or water which is admitted into chamber 19*a*.

Figure 7:
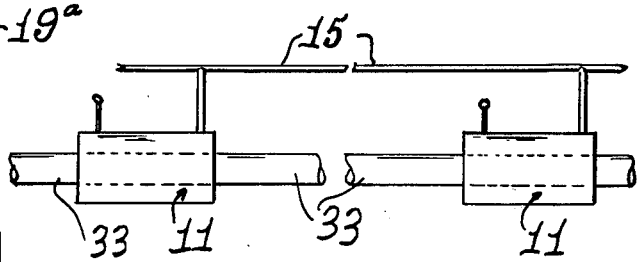
FIG. 7 is a fragmentary sectional view of a horizontal fluid pipe line embodying the jet flow alternator.

The FIG. 7 disclosure of a fragment of a pipe line 33 of any required length useful to convey water, oil or other fluids in a substantially horizontal direction, incorporates the structure of FIG. 2 and like numerals are used to identify corresponding parts. When the interior directional tubes are in neutral position no flow pressure is applied to the fluid in line 33. However, when shifted into a position angularly aligning the tube ports shown in FIGS. 3 and 4, the required jet flow pressure is generated to cause pressurized fluid flow in the selected direction through the line.

FIGS. 8 and 9 are representative of the installation of the jet flow alternator 11 in a land vehicle 34 or water vehicle 35. Here the vehicles will include a pump 16*a* (pumping air for the land vehicle and water or air for the water vehicle) to deliver pressurized fluid into the jet flow alternator, responding to the FIG. 2 alternator disclosure, so as to direct a jet stream therethrough for propelling the vehicle either forwardly or rearwardly, in response to shifting the sheft lever 24*b* or 24*c* in the required direction.

Figure 10:
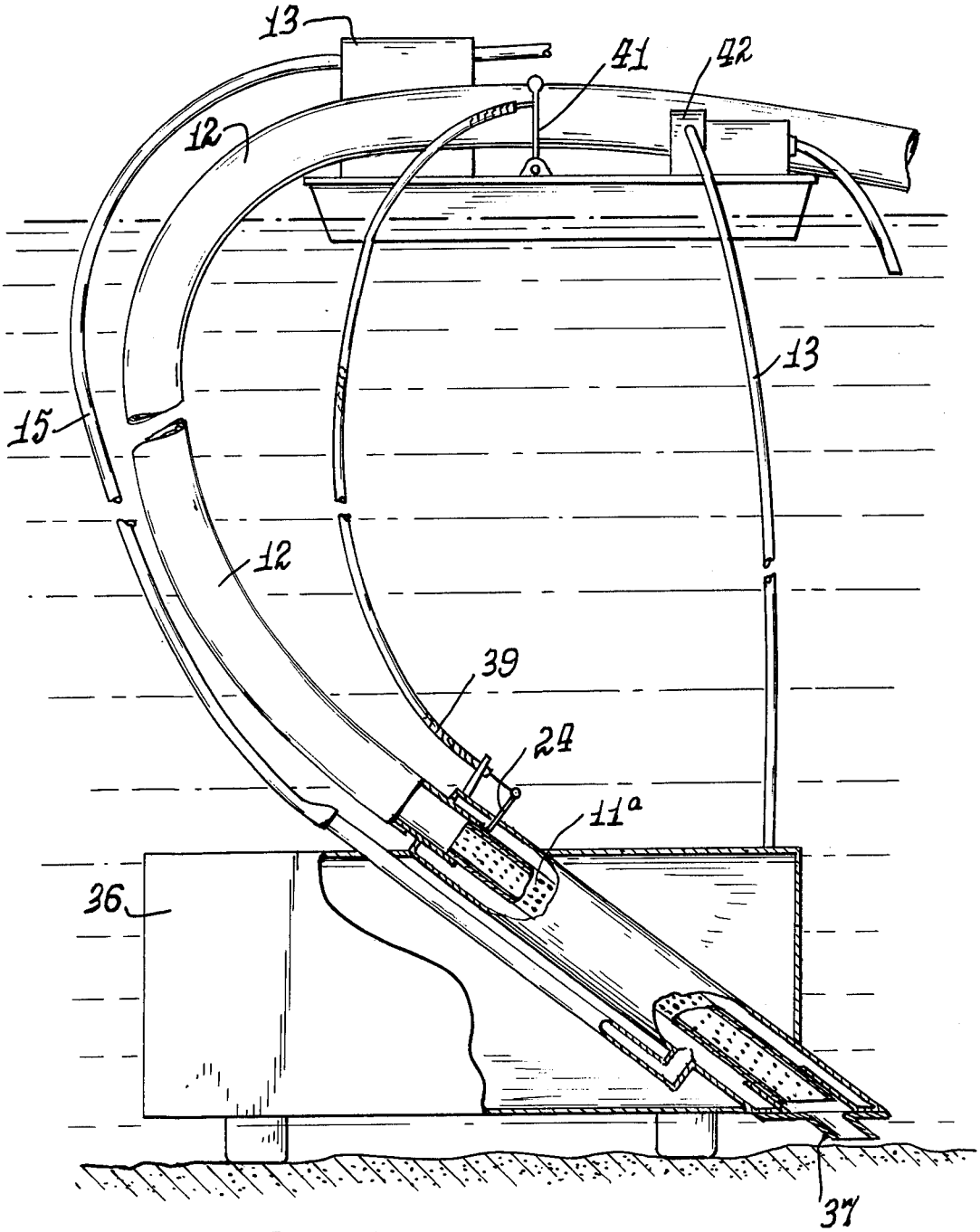
FIG. 10 is representative of another adaptation of the jet flow alternator, useful for deep dredging.

The jet flow alternator illustrated in FIG. 10 is concerned with an exemplary disclosure of structure designed primarily for deep dredging. For example, when dredging the floor of a body of water say about 20 or more feet deep, it may be expedient to submerge the jet flow alternator to the floor. To this end, a submergible tank 36 has the jet flow alternator 11*a* built therein, preferably disposed at an angle and provided at its intake-exhaust end with a reducer nozzle 37. Like numerals have been used to identify parts corresponding to the parts of the embodiments described hereinabove.

In this instance a barge is floated on the top of the body of water which barge carries pump 13 for delivering pressurized fluid through line 15 to the alternator. The alternator has connected to it the suction line 12. Control of the direction of flow through the alternator is obtained as before by means of lever 24 which is in this instance connected by cable 39 to an operator's lever 41 on the barge. Raising and lowering of the tank 36 may be accomplished by alternatly evacuating and flooding of the tank through operation of a water pump 42 on the barge, which is connected to the tank through a line 43.

Although the ports 23 are carried into engaging register in all illustrations by axial shifting of the various tubes it should be evident that by rearranging the ports, the tubes could be shifted one relative to the other by circumferencial rotation of the tubes instead of axial shifting.

It should be apparent that the herein disclosed structures are not expensive or difficult to manufacture and install but are capable of easily, quickly and inexpensively controlling the flow direction of a mass of water, oil, sludge or other fluid or semi-fluid substances.

Although I have described preferred embodiments of my invention, in considerable detail, it will be understood that the description thereof is intended to be illustrative rather than restrictive, as details of the structure may be modified or changed without departing from the spirit or scope of the invention. Accordingly, I do not desire to be restricted to the exact construction shown and described.

I claim:

1. A jet flow alternator for directing the flow of a fluid substance in a select direction comprising, in combination, an outer cylindrical shell, a pipe of lesser diameter than said shell extending axially through said shell and through which a substance flows, means at the ends of said shell closing the space between the shell and pipe to provide a cylindrical chamber between them, a plurality of superposed tubes mounted around said pipe, said tubes being shiftable with respect to each other and said pipe, a plurality of circumferentially and axially spaced apertures in said tubes and pipe, said apertures being aligned normally to provide fluid passageways, means to deliver pressurized fluid of greater pressure than in said pipe into said chamber for passage through said passageways into the interior of the pipe, and means to shift the tubes relative to the pipe and to each other to offset the apertures in the tubes with respect to the apertures in the pipe to direct the pressurized fluid entering the pipe through said passageways towards a selected end of the alternator.

2. The jet flow alternator recited in claim 1, wherein mechanical means is provided to shift the tubes relative to each other and to the pipe.

3. The jet flow alternator recited in claim 1, wherein the outer cylindrical shell of the jet flow alternator constitutes the shaft of a drilling rig.

4. The jet flow alternator recited in claim 1, wherein there are three tubes telescoped one into the other and around the pipe.

5. The jet flow alternator recited in claim 1, wherein there are two tubes telescoped one into the other and around the pipe.

6. The jet flow alternator recited in claim 1, wherein the tubes are shifted axially one relative to each other and to the pipe.

7. The jet flow alternator recited in claim 1, wherein the alternator extends through a water tight float and means is provided to submerge the float in a body of water.

8. In a dredge including a suction line having an open free end resting on the bottom of a body of water, a plurality of superposed telescopic perforated tubes mounted around the free end of said suction line, said suction line including a plurality of perforations, a housing enclosing said tubes and providing an enclosed chamber therearound, means to deliver pressurized fluid of greater pressure than in said suction line to said chamber for passage into the suction line through the perforations, and means to shift the tubes relative to one another and to said suction line to offset the perforations in the tubes relative to the perforations in said suction line for directing the pressurized fluid in a selected direction in said suction line.

* * * * *